US006935060B2

(12) United States Patent
Bjerke et al.

(10) Patent No.: US 6,935,060 B2
(45) Date of Patent: Aug. 30, 2005

(54) MOUNTING SYSTEM FOR LABEL HOLDERS

(75) Inventors: Stein Bjerke, Sundsvall (SE); Kristian Englund, Timrå (SE); Jon Edäng, Kvissleby (SE)

(73) Assignee: HL Display AB, Skarpnäck (SE)

( * ) Notice: Subject to any disclaimer, the term of this patent is extended or adjusted under 35 U.S.C. 154(b) by 0 days.

(21) Appl. No.: 10/240,653

(22) PCT Filed: Mar. 19, 2001

(86) PCT No.: PCT/SE01/00566

§ 371 (c)(1),
(2), (4) Date: Feb. 11, 2003

(87) PCT Pub. No.: WO01/78043

PCT Pub. Date: Oct. 18, 2001

(65) Prior Publication Data

US 2003/0146357 A1 Aug. 7, 2003

(51) Int. Cl.[7] ..... G09F 3/18

(52) U.S. Cl. ..... 40/661.03; 248/220.22; 40/642.01

(58) Field of Search ..... 248/220.22, 223.41; 40/661.03, 651, 649; D20/44

(56) References Cited

U.S. PATENT DOCUMENTS

| | | | | |
|---|---|---|---|---|
| 3,015,897 A | * | 1/1962 | Hopp | 40/650 |
| 3,320,690 A | * | 5/1967 | Forsburg | 40/650 |
| 4,716,669 A | | 1/1988 | Fast | |

(Continued)

FOREIGN PATENT DOCUMENTS

| | | |
|---|---|---|
| DE | 29708636 U1 * | 8/1997 |
| FR | 2726679 A1 | 5/1996 |
| FR | 2 744 825 | 8/1997 |
| SE | 465141 B | 7/1991 |
| WO | WO 91/05324 | 4/1991 |

OTHER PUBLICATIONS

FMI. Designers & Manufacturers, Superdrug Stores PLC Catalogue, pp. 1, 12 & 98.
Fasteners for Retail Cataloge, 1997 Buyers Guide, pp. 11, 12 & 38.
Fasteners for Retail Catalogue, 1995 Buyers Guide, p. 29.
Error BV, Production Plan No. M–5978–01, Apr. 11, 1996.
Error BV, Production Plan No. M–5976–01, Apr. 11, 1996.
Error BV, Production Plan No. M–5977–01, Apr. 26, 1996.
Error BV, Invoice 9943060 to Virupa BV, Apr. 6, 1999.
Error BV, Invoice 9943147 to Virupa BV, Apr. 6, 1999.
Virupa BV, Invoice 30017, Aug. 24, 1999.

(Continued)

*Primary Examiner*—Anita M. King
(74) *Attorney, Agent, or Firm*—Sughrue Mion, PLLC

(57) ABSTRACT

System for arranging holders for information-carrying labels in optional positions along the front edge of a shelf or equivalent. The system comprises a supporting profiled strip (3) with a mounting part adapted so as to allow mounting of the profiled strip on the front edge (2) of a shelf (1) and also a part serving as an attachment for detachable fixing of label holders (7) to the supporting profiled strip. The system is characterized by the combination of the fact that the supporting profiled strip (3) extends along the entire length of a shelf (1) or a shelf section and has a height which essentially corresponds to the height of the front edge of the shelf, and that the label holders (7) consist of short label holder pockets of greater height than the supporting profiled strip (3). When mounted on the supporting profiled strip, the label holder pockets project down below the strip, and they are hinged so as to be capable of being pivoted up in front of the supporting profiled strip.

20 Claims, 4 Drawing Sheets

U.S. PATENT DOCUMENTS

| | | | | | |
|---|---|---|---|---|---|
| 4,805,331 | A | | 2/1989 | Boggess et al. | |
| 5,044,104 | A | * | 9/1991 | Hopperdietzel | 40/654.01 |
| 5,233,773 | A | * | 8/1993 | Reynolds | 40/661.03 |
| 5,419,066 | A | | 5/1995 | Harnois et al. | |
| 5,421,113 | A | | 6/1995 | Gebka et al. | |
| 5,488,793 | A | * | 2/1996 | Gebka et al. | 40/661.03 |
| 5,682,698 | A | | 11/1997 | Bevins | |
| 6,012,244 | A | * | 1/2000 | Begum et al. | 40/661.03 |
| D425,939 | S | | 5/2000 | Kump et al. | |
| 6,163,996 | A | | 12/2000 | Gebka | |
| 6,226,910 | B1 | * | 5/2001 | Ireland | 40/661.03 |
| D446,249 | S | * | 8/2001 | Bjerke et al. | D20/44 |
| D447,184 | S | * | 8/2001 | Bjerke et al. | D20/44 |
| 6,481,133 | B1 | * | 11/2002 | DeSena | 40/661.03 |

OTHER PUBLICATIONS

Benelux Drawings and Design Office, Journal of the Benelux Drawings and Designs, Benelux Design Applicaiton 25057–00. Jan. 21, 1995, p. 82.

August Fischer GmbH, Catalogue, Oct. 1997.

Esselle Meto B.V., 1995/1996 Catalogue, Chapter 6.

Error BV, Production Plan No. P–5400–07.

Australian.

III. Display Belgium N.V., Catalogue, pp. 10, 24, 155.

* cited by examiner

MOUNTING SYSTEM FOR LABEL HOLDERS

FIELD OF THE INVENTION

The invention relates to a system for arranging holders for information-carrying labels in optional positions along the front edge of a shelf or equivalent, comprising a supporting profiled strip which extends along the entire length of the shelf or a shelf section and has a height which essentially corresponds to the height of the front edge of the shelf, and which profiled strip has a mounting part adapted so as to allow mounting of the profiled strip on the front edge of a shelf and a part serving as an attachment for detachable fixing of label holders to the supporting profiled strip.

BACKGROUND OF THE INVENTION

In shops, department stores and the like, where goods and products are kept and displayed on shelves, inter alia price and goods information is usually indicated on labels which are arranged on the shelf front edge or equivalent.

These labels and the holders therefor are very striking and have a strong influence on the impression a customer forms of the shop and the goods display on the shelves. The design of label holder systems is therefore of major importance.

The total space in a shop is determined by the size of the premises and usually represents a limited resource which has to be utilized optimally. This means inter alia that efforts are constantly being made to reduce the thickness of shelves and to position these at an increasingly small mutual spacing in the vertical direction in order to increase the useful goods display space. This makes even greater demands on the label holder system used. Narrow labels with a height corresponding to the thickness of the shelf often do not accommodate the necessary amount of information, if this is to be easily readable. Labels and holders of greater height and which project down below the shelf level encroach on the shelf space below and render the putting-in and removal of goods difficult. Furthermore, long label holders, which extend along a shelf and project down below the shelf level, exaggerate the impression of compactness, which is not attractive and is thus undesirable.

DESCRIPTION OF PRIOR ART

A common type of label system for shop shelves comprises a profiled strip made of plastic which is arranged on the front edge of the shelf, extends along the entire length of the shelf and is made with a front pocket for receiving in a protected manner the necessary number of price tag labels. An example of such a strip is disclosed in WO99/52092. Such strips can also be made in two parts, the pocket consisting of or being formed by a separate part, see for example U.S. Pat. No. 5,263,269.

It is a common feature of this type of label holder that both the holder strip itself and the label-receiving pocket extend along the entire length of the shelf and will, in the case of thin shelves, project down below the shelf. As mentioned above, this gives an unattractive, compact impression when the shelves are located at a small spacing one above another and are filled with goods. Furthermore, such long, downwardly projecting label holders make putting goods onto and removing goods from a shelf level below difficult.

WO92/20056 describes a label holder with a height which does not exceed the thickness of the shelf. In this connection, in order to make the information readable, in particular on the highest and lowest shelf levels, the label holder is made with a magnifying lens. This renders the label holder system more complicated and more expensive.

It is also known to use short label holders which project down below the shelf level. These are usually attached directly to the front edge of the shelf, which means that they are difficult to move into another position along the shelf. Alternatively, they require shelves with a specially designed front which fits one type of label holder, which limits application and results in increased costs.

OBJECTS OF THE INVENTION

One object of the present invention is to produce a label holder system for shop shelves and the like, which allows thin shelves to be arranged at a relatively small mutual spacing in the vertical direction without appreciably affecting the overall impression, with maintained readability of the label information and also without rendering putting goods onto and removing goods from a shelf level below appreciably difficult.

Another object is to produce such a label holder system which allows simple positioning of the individual labels along the length of the shelf.

A further object is to produce a label holder system which also allows mounting of other accessories on the shelf front edge, such as projecting information or advertising panels.

A further object is to produce a label holder system which, in order to make this system generally applicable, uses a supporting profiled strip with a part which is intended as an attachment for label holders and has the same profile irrespective of the remainder of the appearance of the supporting profile.

The above objects are achieved according to the present invention by means of a label holder system of the type indicated in the first paragraph, which is characterized in that the label holders comprise short label holder pockets of greater height than the supporting profiled strip, which pockets project down below the supporting profiled strip when the label holders are mounted thereon, in that the label holder pockets are hinged so that they can be pivoted up in front of the supporting profiled strip, in that that part of the supporting profiled strip serving as the attachment for the label holders has a forwardly arched front, a rounded lower portion and an upper peak-like projection, and in that the label holders have a part which is intended for interaction with the attachment part of the supporting profiled strip and has an upper portion adapted so as to be capable of extending in under the peak-like projection of the attachment part of the supporting profiled strip, and a rounded lower part adapted so as to be capable of being snapped firmly over the rounded lower portion of the attachment part of the supporting profiled strip.

Other characteristics of a label holder system according to the invention emerge from the following patent claims.

The invention will be described in greater detail below with reference to the embodiments shown by way of example in the accompanying drawings.

BRIEF DESCRIPTION OF THE DRAWINGS

In FIG. 1, reference number 1 designates a shelf, in this case made of a bent plate and with a shelf front edge 2. Arranged on the shelf front edge is a supporting profiled strip 3 which extends over the entire length of the shelf and is suitably extruded in a PVC material. The profiled strip 3 has a height which essentially corresponds to the height of the front part of the shelf 1, so that it does not project down appreciably below the shelf front edge 2. The profiled strip 3 can be formed so that it constitutes a decorative contribution to the goods display and can, for example, be made in a colour which suits the situation.

Figure 1:
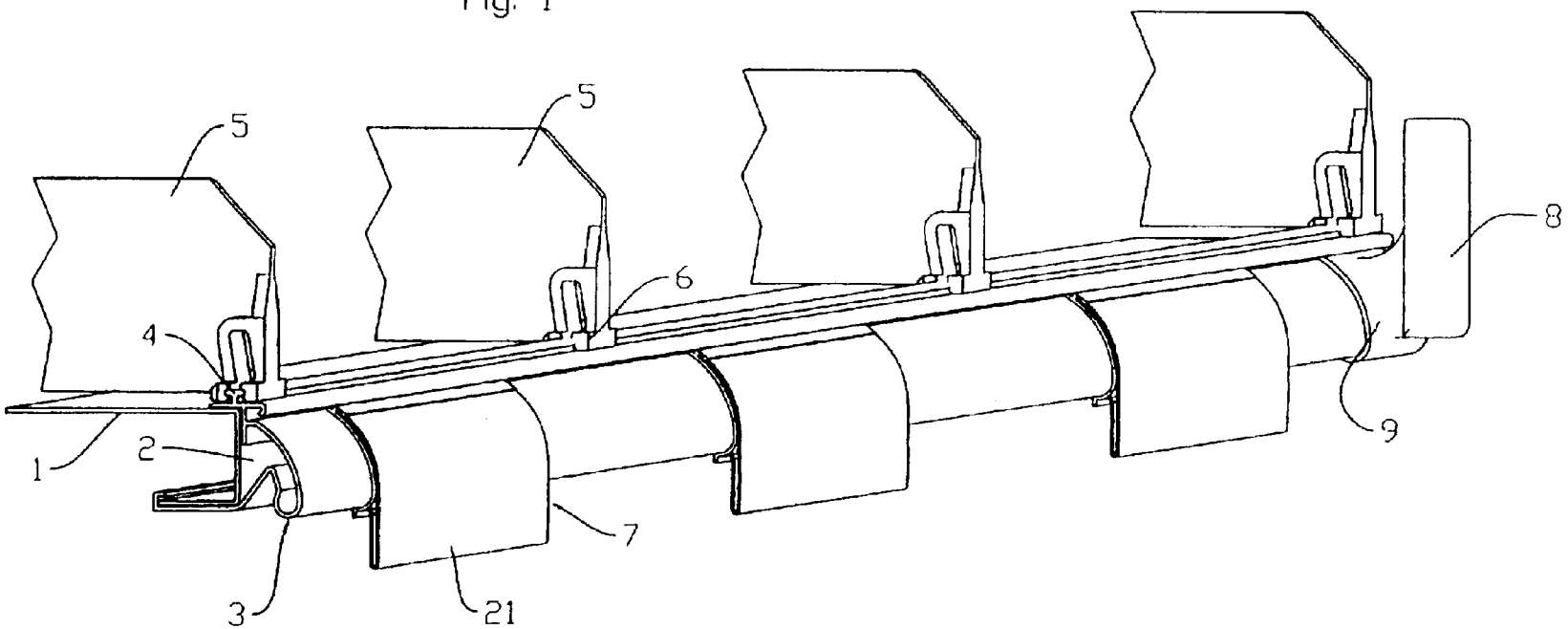
FIG. 1 is a perspective view of a shelf provided with a label holder system according to the present invention.

The supporting profiled strip 3 is made with an upwardly projecting, longitudinal rail 4, on which dividers 5 are mounted, which extend transversely to the shelf and divide the latter into the desired goods compartments. Each divider 5 is made with a front mounting shoe 6 which engages over the rail 4 and allows the divider to be secured on the rail in the desired position. In front of the goods compartments formed by the dividers 5, label holders 7 are snapped firmly on the supporting profiled strip 3. These holders are intended to be provided with labels carrying prices and other information relating to the goods in the respective goods compartment.

In order to make this information easily readable, a part of the label holders 7 has a greater height than the supporting profiled strip 3, which means that these parts project down below the latter. As it is only these relatively short parts of the label holders which project down below the shelf front edge 2, the overall impression of the goods display in the shop is not affected in the same way as if the entire longitudinal profiled strip were to have the greater height. This would, in particular in the case of shelves which are located at a small mutual spacing in the vertical direction, create an altogether too compact impression. In this connection, putting goods onto and removing goods from shelf levels below would also be rendered difficult.

The front parts made as pockets 21 of the label holders 7 can be pivoted up in front of the profiled strip 3, as will be described below. The result of this is that they do not hinder the removal of goods from shelf levels below. When new goods are put onto the shelf below, the pockets 21 can simply be pivoted up by hand.

Reference number 8 designates a panel projecting from the shelf 1, which is intended, for example, to carry an advertising message. This panel is made with a mounting foot 9 which allows it to be mounted on the same supporting profiled strip 3 as the label holders 7.

The embodiment of the supporting profiled strip 3 and the label holders 7 will now be described in greater detail with reference to FIGS. 2–6.

Figure 2:
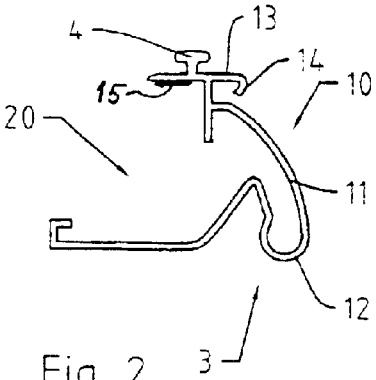
FIG. 2 shows the profile of the supporting profiled strip included in FIG. 1.

In FIG. 2, reference number 20 designates the mounting part of the supporting profiled strip 3. In this example, this part is made in order to fit on the plate shelf 1 shown in FIG. 1. The mounting part 20 will vary depending on the type of shelf or the like on which the supporting profiled strip 3 is to be mounted. The front part 10 of the profiled strip 3 forms an attachment part for the label holders 7. The attachment part 10 comprises an arched front surface 11, a lower rounded portion 12 and an upper peak-like projection 13 with a downwardly projecting, hook-shaped portion 14. This attachment part has the same profile irrespective of the design of the mounting part 20. This means inter alia that it is possible to use a standardized label holder with an attachment part with the same profile irrespective of the type of shelf on which it is to be mounted and irrespective of the size and the design of the remainder of the holder. Other accessories, such as for example the advertising panel 8 in FIG. 1, can also be made with a corresponding mounting foot 9 which fits on the attachment part 10 of the profiled strip 3.

The designation 4 relates as previously to the rail intended for the mounting of dividers 5. In applications in which dividers are not to be used, this rail can be omitted. Reference number 15 designates a friction-increasing band which can consist of, for example, plasticized PVC material or an elastomer and is suitably coextruded with the remainder of the supporting profile. When the profiled strip 3 is loaded, this friction band will be pressed against the upper surface of the shelf 1 and will then prevent sliding between the latter and the mounting part 20 of the profiled strip.

Figure 3:
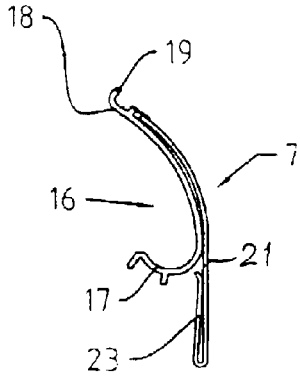
FIG. 3 shows the profile of the label holder included in FIG. 1.

FIG. 3 shows a label holder 7 which comprises a rear attachment part 16 with an arched shape, a lower rounded portion 17, an upwardly projecting portion 18 with a hook-shaped end 19 and an upwardly pivotable front part 21 made as a pocket. The entire holder 7 is suitably extruded in a PVC material. To mount the holder 7 on a supporting profiled strip 3 mounted on a shelf 1, the portion 18 is inserted under the projecting "peak" 13 of the profiled strip 3, so that the hook means 14 and 19 enter into engagement with one another. The lower rounded portion 17 of the pocket 7 is then snapped firmly over the lower rounded portion 12 of the profiled strip 3, see FIG. 5. The holder 7 will then be held securely on the supporting profiled strip 3. To move the holder to another position along the profiled strip 3, all that is necessary is to release the snap engagement between the parts 17 and 12 and to reapply it in the new position.

Figure 4:
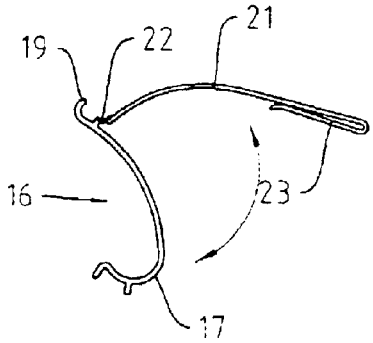
FIG. 4 shows the front part of the label holder made as a pocket in the pivoted-up state.
Figure 5:
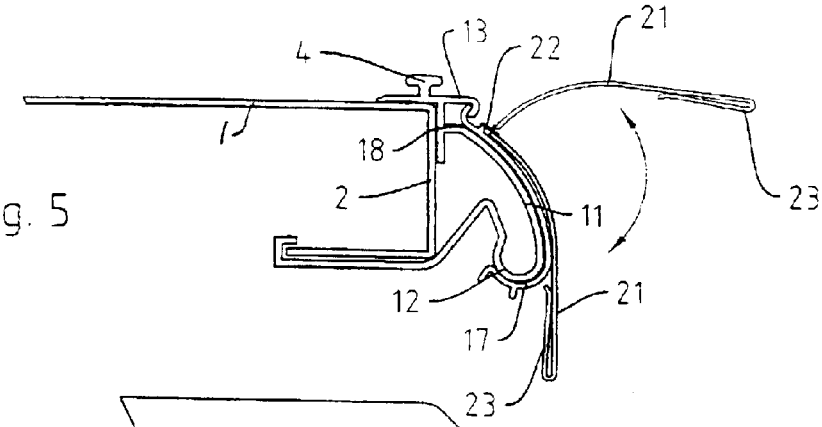
FIG. 5 is a side view of the front edge of a shelf with a mounted label holder system according to the invention.

In order that the downwardly projecting front pocket 21 of the holder 7 does not hinder the removal of goods from a shelf level below, the front pocket can be pivoted up, as is illustrated in FIGS. 4 and 5. In this connection, the front pocket 21 is pivoted up around a transverse hinge axis 22 when an item comes into contact with the front part. The hinge axis can be produced simply in the form of a material portion which is made slightly thinner in connection with extrusion of the holder. In the mounted state, the pocket 21 can also easily be pivoted up by hand, for example to put new goods onto a shelf level below. In the embodiment shown, a price tag label or equivalent can be guided down into the lower folded-over portion 23 of the pocket 21. This label will then be protected against external influences and soiling by the continuous front surface of the pocket.

Figure 6:
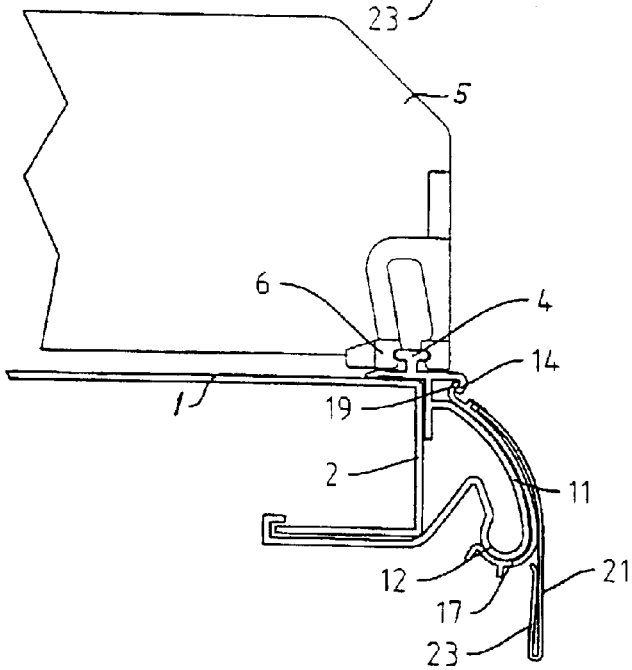
FIG. 6 corresponds to FIG. 5, the shelf having been provided with a divider.

FIG. 6 corresponds to FIG. 5, a divider 5 being mounted by its mounting shoe 6 on the rail 4 projecting upwardly from the supporting profiled strip 3, as described above.

Figure 7:
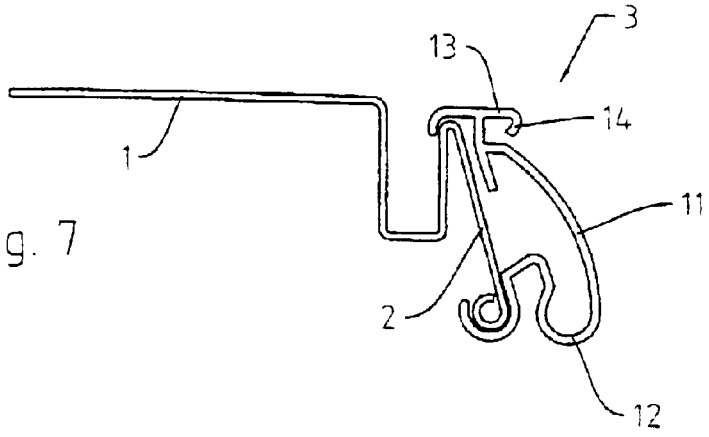
FIGS. 7–9 show supporting profiled strips according to the invention adapted to different shelf designs.
Figure 8:
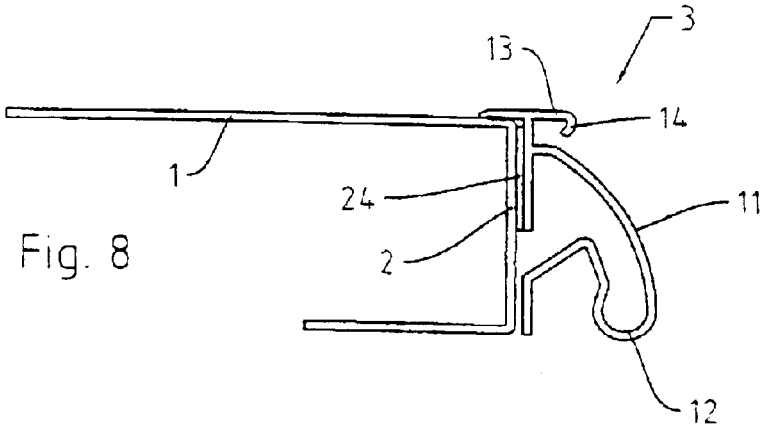
Figure 9:
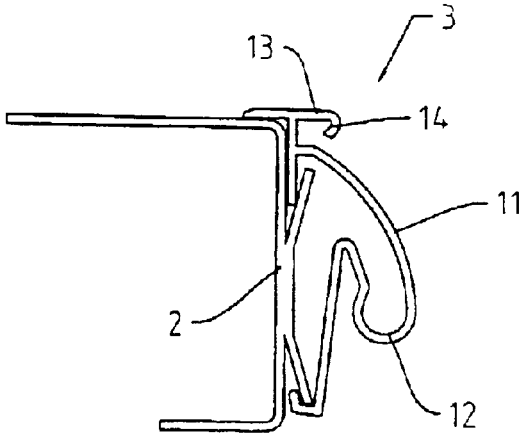

FIGS. 7, 8 and 9 show profiled strips 3 according to the present invention mounted on shelves 1 with shapes different from that shown in FIG. 1. In this connection, the mounting part of the different profiled strips 3 has been adapted to the shape of the front edge of the respective shelf. In FIG. 7, the profiled strip 3 is snapped firmly over a front portion 2 of the shelf, while the strip in FIG. 8 is fixed to the front edge 2 of the shelf by means of a double-sided adhesive tape 24. The profiled strip 3 in FIG. 9 is adapted for a shelf with a specially made front part 2.

Although the mounting part 20 of the profiled strip 3 differs in the examples shown, the attachment part 10 of the strip is identical in all cases.

This means that label holders or other accessories with a design adapted to this profiled strip can be mounted on any shelf irrespective of the design of the front edge of the shelf.

Figure 10:
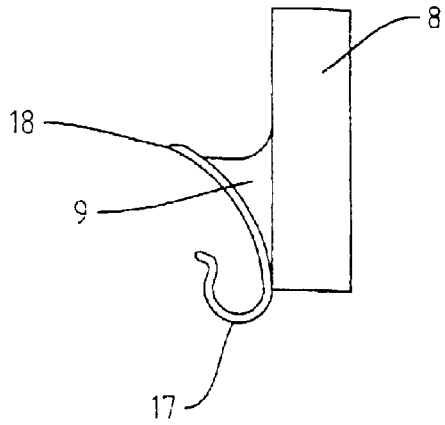
FIG. 10 shows an information panel intended for mounting on a supporting profiled strip according to the invention.

FIG. 10 shows an information panel 8 according to FIG. 1 provided with a mounting foot 9 with a profile corresponding to the attachment part 10 of the profiled strips 3 described previously. Compared with the label holders 7, the lower rounded portion 17 of the mounting foot 9 has a slightly deeper shape so as to bring about a more secure grip around the lower rounded portion 12 of the profiled strip 3, see FIG. 11. For mounting, the rounded portion 17 is then first arranged over the rounded portion 12 of the profiled strip, after which the upper edge portion 18 of the mounting foot 9 is inserted under the peak-like projection 13 of the profiled strip 3. In this connection, the free end portion 18 can be made without a hook portion.

Figure 11:
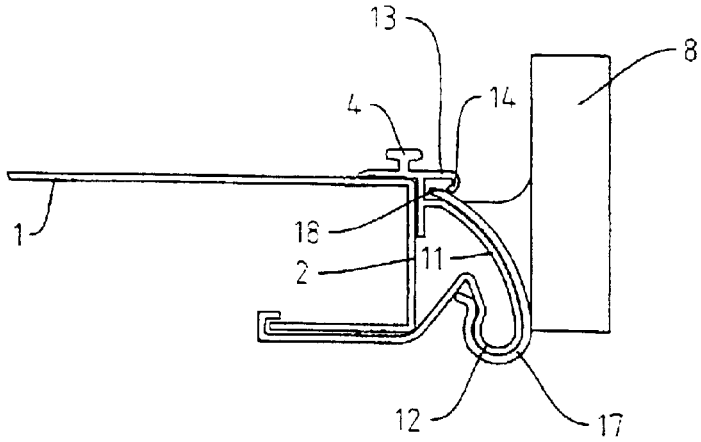
FIG. 11 shows the information panel according to FIG. 10 mounted on a supporting profiled strip which is arranged on a shelf.
Figure 12:
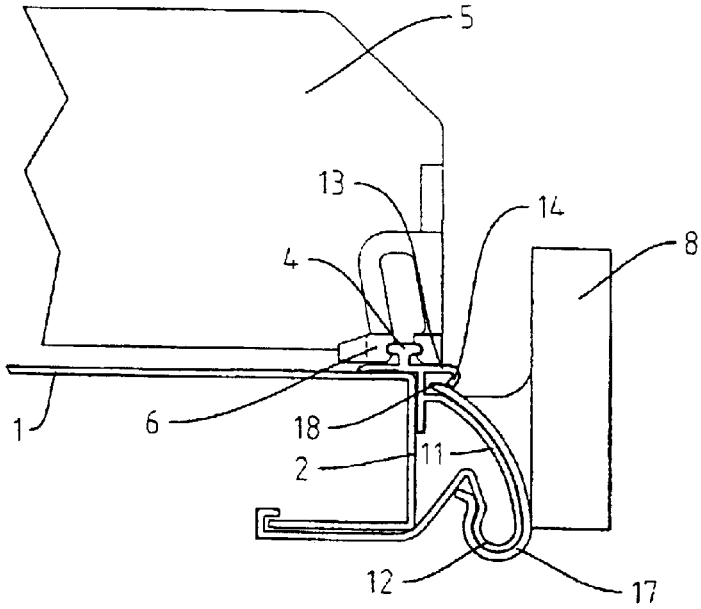
FIG. 12 corresponds to FIG. 11, the shelf having been provided with a divider.

FIG. 12 corresponds to FIG. 11, the shelf having been provided with a divider 5 which is mounted by means of its mounting shoe 6 on the rail 4 projecting upwardly from the supporting profiled strip 3.

An information panel 8 or other accessory with the standardized mounting foot 9 can also therefore be mounted on all the profiled strips 3 which can be adapted to different shelves.

The invention has been described above in connection with the embodiments shown by way of example in the drawings. However, these can be varied in a number of respects within the scope of the patent claims. The attachment part of the profiled strip and the corresponding mounting part of the label holders can therefore be given a different shape on condition that they fit together and provide secure holding of the holder on the strip.

What is claimed is:

1. A system for arranging holders for information-carrying labels in optional positions along the front edge of a shelf or equivalent, comprising:

a supporting profiled strip (3), which has a mounting part (20) adapted so as to allow mounting of the profiled strip on the front edge (2) of the shelf (1); and a part (10) serving as an attachment for detachable fixing of label holders (7) to the supporting profiled strip, wherein:

the profiled strip (3) is intended to extend along the length of the shelf (1) or a shelf section and has a height which essentially corresponds to the height of the front edge of the shelf;

the label holders (7) comprise short attachment parts (16) adapted so as to allow mounting of a number of label holders on the same supporting profiled strip (3) and label holder pockets (21) of greater height than the supporting profiled strip (3);

the pockets project down below the supporting profiled strip when the label holders are mounted thereon; and the label holder pockets (21) are hinged to the short attachment part (16) of the respective label holder so that they can be pivoted up in front of the supporting profiled strip.

2. The system according to claim 1, wherein the attachment part of the supporting profiled strip (3) serving as the attachment (10) for label holders (7) has a same profile irrespective of the profile of the mounting part.

3. The system according to claim 1, wherein the attachment part of the supporting profiled strip (3) has a forwardly arched front (11), a rounded lower portion (12) and an upper peak-like projection (13).

4. The system according to claim 3, wherein the peak-like projection (13) of the supporting profiled strip (3) has a front, downwardly projecting, hook-shaped portion (14).

5. The system according to claim 3, wherein the short attachment part (16) of each label holder (7) is intended for interaction with the attachment part (10) of the supporting profiled strip (3) and has an upper portion (18) adapted so as to be capable of extending in under the peak-like projection (13) of the attachment part (10) of the supporting profiled strip (3), and a rounded lower part (17) adapted so as to be capable of being snapped firmly over the rounded lower portion (12) of the attachment part of the supporting profiled strip.

6. The system according to claim 5, wherein said upper portion (18) of the attachment part of the label holders (7) has an upwardly projecting, hook-shaped portion (19) which is adapted so as to enter into engagement with the downwardly projecting, hook-shaped portion (14) of said peak-like projection (13).

7. The system according to claim 3, wherein each label holder pocket (21) can be pivoted up around a transverse hinge axis (19) which runs parallel to the a free edge of said peak-like projection (13).

8. The system according to claim 3, wherein the label holder pockets (21) have a full front surface, the upper portion of which extends in under the peak-like projection (13) of the supporting profiled strip (3), so that a label arranged inside the front surface is protected against external influences and soiling.

9. The system according to claim 1, comprising information panels (8) which can be mounted on the supporting profiled strip (3) and project essentially at right angles from the supporting profiled strip, and in that these panels have a mounting foot (9) intended for interaction with the attachment part (10) of the supporting profiled strip.

10. The system according to claim 9, wherein said mounting foot (9) has a rounded lower part (17) adapted so as to be capable of being arranged over the rounded lower portion (12) of the attachment part (10) of the supporting profiled strip and an upper portion (18) adapted so as to be capable of being inserted in under the peak-like projection (13) of said attachment part.

11. A label holder of the type which forms part of a label holder system according to claim 1.

12. A supporting profiled strip of the type which forms part of a label holder system according to claim 1.

13. A system for arranging holders for information-carrying labels in optional positions along the front edge of a shelf or equivalent, comprising:

a supporting profiled strip, which has a mounting part adapted so as to allow mounting of the profiled strip on the front edge of the shelf; and a part serving as an attachment for detachable fixing of label holders to the supporting profiled strip, wherein:

the profiled strip is intended to extend along the length of the shelf or a shelf section and has a height which essentially corresponds to the height of the front edge of the shelf;

the label holders comprise short attachment parts adapted so as to allow mounting of a number of label holders on the same supporting profiled strip and label holder pockets of greater height than the supporting profiled strip;

the pockets project down below the supporting profiled strip when the label holders are mounted thereon;

the label holder pockets are hinged to the short attachment part of the respective label holder so that they can be pivoted up in front of the supporting profiled strip; and the attachment part of the supporting profiled strip has a forwardly arched front, a rounded lower portion and an upper peaked projection.

14. The system according to claim 13, wherein the peak-like projection of the supporting profiled strip has a front, downwardly projecting, hook-shaped portion.

15. The system according to claim 13, wherein the short attachment part of each label holder is intended for interaction with the attachment part of the supporting profiled strip and has an upper portion adapted so as to be capable of extending in under the peak-like projection of the attachment part of the supporting profiled strip, and a rounded lower part adapted so as to be capable of being snapped firmly over the rounded lower portion of the attachment part of the supporting profiled strip.

16. The system according to claim 15, wherein said upper portion of the attachment part of the label holders has an upwardly projecting, hook-shaped portion which is adapted so as to enter into engagement with the downwardly projecting, hook-shaped portion of said peak-like projection.

17. The system according to claim 13, wherein each label holder pocket can be pivoted up around a transverse hinge axis which runs parallel to a free edge of said peak-like projection.

18. The system according to claim 13, wherein the label holder pockets have a full front surface, the upper portion of which extends in under the peak-like projection of the supporting profiled strip, so that a label arranged inside the front surface is protected against external influences and soiling.

19. A system for arranging holders for information-carrying labels in optional positions along the front edge of a shelf or equivalent, comprising:

a supporting profiled strip, which has a mounting part adapted so as to allow mounting of the profiled strip on the front edge of the shelf; and a part serving as an attachment for detachable fixing of label holders to the supporting profiled strip, wherein:

the profiled strip is intended to extend along the length of the shelf or a shelf section and has a height which essentially corresponds to the height of the front edge of the shelf;

the label holders comprise short attachment parts adapted so as to allow mounting of a number of label holders on the same supporting profiled strip and label holder pockets of greater height than the supporting profiled strip;

the pockets project down below the supporting profiled strip when the label holders are mounted thereon; and the label holder pockets are hinged to the short attachment part of the respective label holder so that they can be pivoted up in front of the supporting profiled strip, the system further comprising information panels which can be mounted on the supporting profiled strip and project essentially at right angles from the supporting profiled strip, and in that these panels have a mounting foot intended for interaction with the attachment part of the supporting profiled strip, wherein said mounting foot has a rounded lower part adapted so as to be capable of being arranged over the rounded lower portion of the attachment part of the supporting profiled strip and an upper portion adapted so as to be capable of being inserted in under the peak-like projection of said attachment part.

20. The system according to claim 19, wherein the label holders hang loosely in front of the short attachment parts.

* * * * *